US007567145B2

(12) United States Patent
Akasegawa et al.

(10) Patent No.: US 7,567,145 B2
(45) Date of Patent: Jul. 28, 2009

(54) SUPERCONDUCTING TUNABLE FILTER

(75) Inventors: Akihiko Akasegawa, Kawasaki (JP); Kazuaki Kurihara, Kawasaki (JP); Kazunori Yamanaka, Kawasaki (JP); Shigetoshi Ohshima, Yonezawa (JP); Atsushi Saito, Yonezawa (JP)

(73) Assignee: Fujitsu Limited, Kawasaki (JP)

( * ) Notice: Subject to any disclaimer, the term of this patent is extended or adjusted under 35 U.S.C. 154(b) by 155 days.

(21) Appl. No.: 11/606,033

(22) Filed: Nov. 30, 2006

(65) Prior Publication Data

US 2009/0167460 A1 Jul. 2, 2009

(30) Foreign Application Priority Data

Jul. 24, 2006 (JP) ..... 2006-200791

(51) Int. Cl.
*H01P 1/203* (2006.01)

(52) U.S. Cl. ..... 333/99 S; 333/205; 505/210

(58) Field of Classification Search ..... 333/204, 333/205, 219, 235, 99 S; 505/210
See application file for complete search history.

(56) References Cited

U.S. PATENT DOCUMENTS

| | | | | |
|---|---|---|---|---|
| 6,360,112 | B1 * | 3/2002 | Mizuno et al. | 505/210 |
| 6,778,042 | B2 * | 8/2004 | Terashima et al. | 333/205 |
| 7,174,197 | B2 * | 2/2007 | Kai et al. | 505/210 |

FOREIGN PATENT DOCUMENTS

| | | |
|---|---|---|
| JP | 2002-57506 | 2/2002 |
| JP | 3535469 | 3/2004 |

* cited by examiner

*Primary Examiner*—James Cho
(74) *Attorney, Agent, or Firm*—Fujitsu Patent Center

(57) ABSTRACT

A superconducting tunable filter is disclosed that has a center frequency and a bandwidth able to be adjusted separately. The superconducting tunable filter includes a superconducting resonator filter pattern formed on a dielectric substrate; a dielectric or magnetic plate above the resonator filter pattern and having a through-hole; a dielectric or magnetic rod inserted in the through-hole; and a position controller which separately controls the position of the dielectric or magnetic plate and the position of the dielectric or magnetic rod relative to the resonator filter pattern.

7 Claims, 6 Drawing Sheets

SUPERCONDUCTING TUNABLE FILTER

CROSS-REFERENCE TO RELATED APPLICATION

This patent application is based on Japanese Priority Patent Application No. 2006-200791 filed on Jul. 24, 2006, the entire contents of which are hereby incorporated by reference.

BACKGROUND OF THE INVENTION

1. Field of the Invention

The present invention relates to a superconducting tunable filter, particularly, to a superconducting tunable filter whose center frequency and bandwidth are both adjustable.

2. Description of the Related Art

In recent years and continuing, along with transition to high speed, large capacity data communication, such as the next generation mobile communication system, and a wide-band wireless access system, effective utilization of frequency resources becomes indispensable. In order to obtain the best communication access, a communication apparatus supporting plural frequency bands is desirable. A leading candidate for solving the frequency interference problem is high-Q superconducting filter technology, which has low loss, good frequency cutoff characteristics, and a tunable function.

FIG. 1A is a diagram illustrating a micro-strip superconducting resonator filter pattern of the related art.

As shown in FIG. 1A, a micro-strip superconducting resonator filter pattern 112 is formed from superconducting micro-strip lines, and electromagnetic fields are coupled between plural resonators and between resonators and filters, thereby forming a superconducting band-pass filter.

The center frequency or bandwidth, cutoff characteristics, and out-of-band suppression characteristics of the filter are determined by the resonating frequencies fo and resonator coupling coefficients k of the resonators, and an external Q-value. Hence, if the resonating frequencies fo and resonator coupling coefficients k are variable, the filter becomes a tunable filter. For this purpose, from the point of view of material properties, it is sufficient to make at least one of the effective relative permittivity $\in_{eff}$ and the effective relative permeability $\mu_{eff}$ variable; alternatively, from the point of view of circuitry, it is sufficient to make at least one of capacitance C and inductance L variable.

However, in order to maintain the performance of a high Q-value filter, it is necessary to avoid increase of the loss caused by the tunable mechanism. In the related art, a tunable filter can be realized by three methods, namely, electric field control, magnetic field control, and mechanical control. Among the three methods, mechanical control can provides the largest tunability, and hence it is anticipated to be an effective method to maintain low loss.

FIG. 1B is a view illustrating a superconducting tunable filter in the related art.

As shown in FIG. 1B, a micro-strip superconducting resonator filter pattern 112 is formed on a dielectric substrate 111, and a dielectric plate or a magnetic plate 120, which has low loss, is arranged on the micro-strip superconducting resonator filter pattern 112. An actuator 121, such as a piezoelectric element, is used to change the distance between the micro-strip superconducting resonator filter pattern 112 and the dielectric (or magnetic) plate 120. Thereby, the effective relative permittivity $\in_{eff}$ or the effective relative permeability $\mu_{eff}$ is changed, and thereby, obtaining a tunable filter.

For example, Japanese Patent Gazette No. 3535469 discloses such a technique.

However, in the related art, since the entire upper surface of the micro-strip superconducting resonator filter pattern 112 is covered by the dielectric plate 120, the bandwidth ends up being changed when the variable range of the center frequency increases, and this limits the tunable range. Although it is possible to adjust the in-band characteristics (such as, the bandwidth) of the filter by inserting a dielectric rod or a magnetic rod from the upper side, in this case it is difficult to make the center frequency variable.

Japanese Laid-Open Patent Application No. 2002-57506 discloses a technique for adjusting the in-band characteristics by inserting a dielectric rod or a magnetic rod from the upper side.

As described above, in the related art, although it is possible to make one of the center frequency and the bandwidth tunable, it is difficult to separately change both of the center frequency and the bandwidth.

SUMMARY OF THE INVENTION

The present invention may solve one or more of the problems of the related art.

A preferred embodiment of the present invention may provide a superconducting tunable filter having a center frequency and a bandwidth able to be adjusted independently.

According to an aspect of the present invention, there is provided a superconducting tunable filter, comprising:

a resonator filter pattern that is formed from a superconducting material and is formed on a dielectric substrate;

a dielectric or magnetic plate that is arranged above the resonator filter pattern and has a through-hole;

a dielectric or magnetic rod that is inserted in the through-hole; and a position controller that separately controls a position of the dielectric or magnetic plate and a position of the dielectric or magnetic rod relative to the resonator filter pattern.

As an embodiment, the position controller may include a rod adjusting trimmer for adjusting the position of the dielectric or magnetic rod relative to the resonator filter pattern.

As an embodiment, the position controller may include a plate adjusting trimmer for adjusting the position of the dielectric or magnetic plate relative to the resonator filter pattern.

As an embodiment, the position controller may include plural piezoelectric actuators or MEMS elements arranged on the dielectric or magnetic plate and the dielectric or magnetic rod, respectively.

As an embodiment, the resonator filter pattern may be an arrangement pattern including plural resonators arranged adjacent to each other, and the through-hole may be located between adjacent two of the resonators or between the resonators and an input-output feeder for transmitting signals to the resonators.

Alternatively, the resonator filter pattern may be an arrangement pattern including plural disk-like resonators arranged adjacent to each other, and the through-hole may be located between adjacent two of the disk-like resonators or between the disk-like resonators and an input-output feeder for transmitting signals to the disk-like resonators.

As an embodiment, the superconducting tunable filter may further comprise:

a package that accommodates the dielectric substrate with the superconducting resonator filter pattern formed thereon, the dielectric or magnetic plate, and the dielectric or magnetic rod, wherein the position controller may be arranged outside the package.

As an embodiment, the position controller may include plural adjusting trimmers arranged on the package corresponding to the dielectric or magnetic plate and the dielectric or magnetic rod, respectively.

According to the superconducting tunable filter of the present invention, a dielectric or magnetic plate having a through-hole and having low loss is used, a bandwidth tuning rod is inserted in the through-hole, the position of the dielectric or magnetic plate and the position of the bandwidth tuning rod can be adjusted relative to the resonator filter pattern separately. Due to this structure, it is possible to adjust the center frequency and the bandwidth of the superconducting tunable filter of the present invention separately. Namely, by separately controlling the dielectric or magnetic plate and the bandwidth tuning rod, it is possible to separately adjust the distance between the dielectric or magnetic plate and the resonating filter pattern, and the distance between the bandwidth tuning rod and the resonating filter pattern, and hence, not only the center frequency of the superconducting tunable filter, but also the bandwidth of the superconducting tunable filter can be adjusted independently as desired.

These and other objects, features, and advantages of the present invention will become more apparent from the following detailed description of the preferred embodiments given with reference to the accompanying drawings.

DESCRIPTION OF THE PREFERRED EMBODIMENTS

Below, preferred embodiments of the present invention are explained with reference to the accompanying drawings.

Figure 1A:
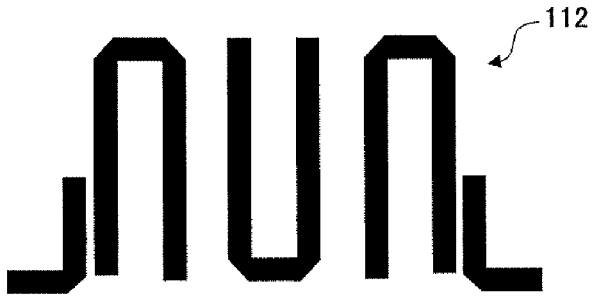
FIG.1A RELATED ART
FIG. 1A is a diagram illustrating a micro-strip superconducting resonator filter pattern of the related art.
Figure 1B:
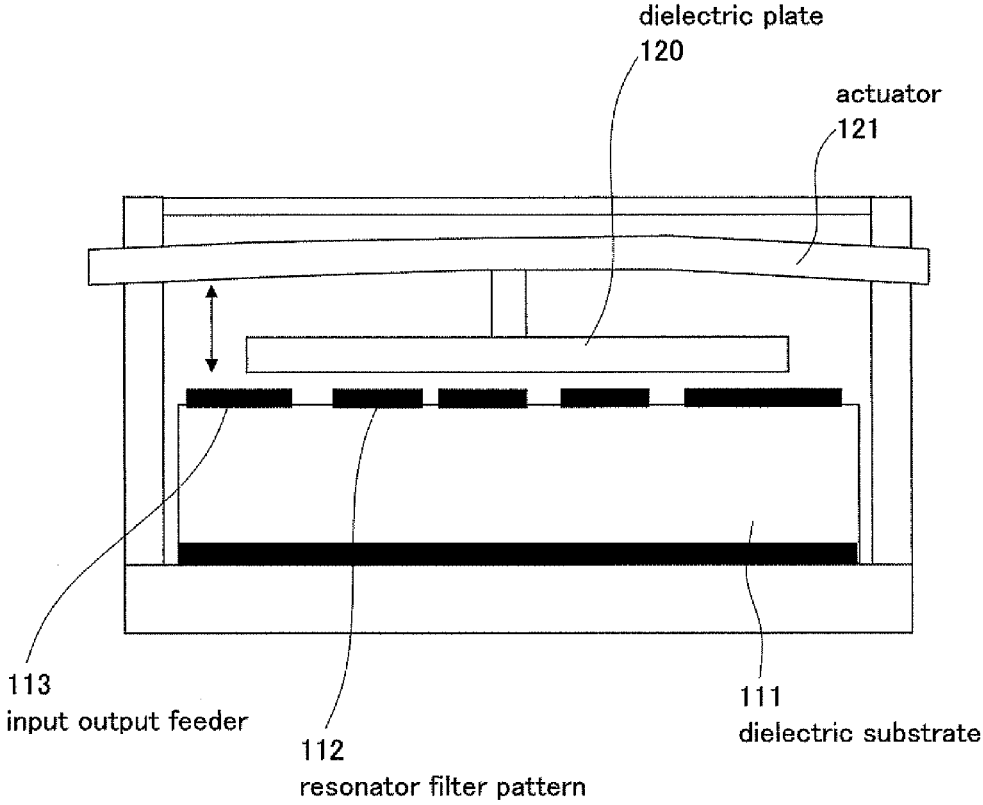
FIG.1B RELATED ART
FIG. 1B is a view illustrating a superconducting tunable filter in the related art.
Figure 2A:
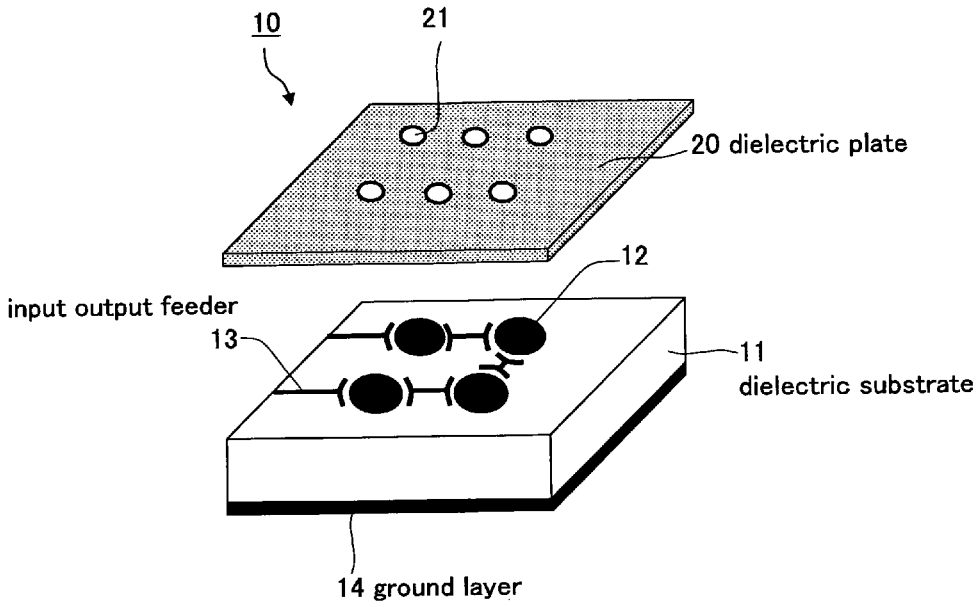
FIG. 2A is a perspective view illustrating a configuration of a superconducting tunable filter according to an embodiment of the present invention.

FIG. 2A is a perspective view illustrating a configuration of a superconducting tunable filter according to an embodiment of the present invention.

Figure 2B:
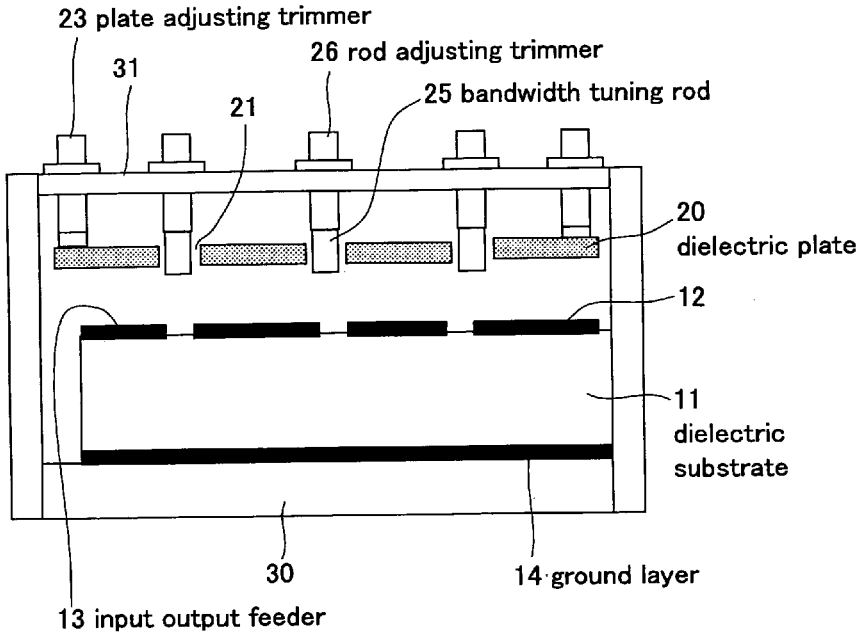
FIG. 2B is a cross-sectional view illustrating a configuration of a superconducting tunable filter according to an embodiment of the present invention.

FIG. 2B is a cross-sectional view illustrating a configuration of a superconducting tunable filter according to an embodiment of the present invention.

As illustrated in FIG. 2A, a superconducting tunable filter 10 has a dielectric substrate 11 which is formed from a MgO single crystal, a resonator filter pattern 12 which is arranged on the dielectric substrate 11 to have a specified shape, and is formed from a superconducting material, a signal input-output line (below, referred to as "feeder") 13 formed near the resonator filter pattern 12, and a ground electrode (below, referred to as "ground layer") 14 formed on the back surface of the dielectric substrate 11. For example, the superconducting material used for the resonator filter pattern 12 may be YBCO (Y—Ba—Cu—O) based materials.

In FIG. 2A and FIG. 2B, as an example, it is illustrated that the superconducting resonator filter pattern 12 has a disk pattern (two-dimension circuit pattern), which is promising for signal transmission, but the present embodiment is not limited to this example. For example, the superconducting resonator filter pattern 12 may have a one-dimension strip pattern formed from hair-pins.

In the example shown in FIG. 2A and FIG. 2B, plural disk-like resonators are coupled electromagnetically to form a superconducting band-pass filter.

In the present application, the term "two-dimension circuit pattern" is used to have a different meaning from a line pattern or a strip pattern (one-dimension pattern), which means a planar pictorial pattern, such as a circle, an ellipse, a polygonal shape.

An end of the signal input-output line 13, which extends toward the superconducting resonator filter pattern 12 from an electrode for signal input and output (not illustrated), is used for inputting signals, and the other end of the signal input-output line 13 is used for outputting signals.

As shown in FIG. 2A and FIG. 2B, a dielectric (such as sapphire) plate 20 is arranged above the dielectric substrate 11, which serves as a base. The dielectric plate 20 is arranged so that the position of the dielectric plate 20 can be adjusted, by plate adjusting trimmers 23, in the vertical direction in FIG. 2A and FIG. 2B.

Plural through-holes 21 are formed in the dielectric plate 20, and a bandwidth tuning rod 25 is inserted in each of the through-holes 21. The vertical position of each bandwidth tuning rod 25 can be adjusted by a corresponding rod adjusting trimmer 26. The through-holes 21 in the dielectric plate 20 are positioned in such a way so that the bandwidth tuning rods 25 are located between two adjacent disk-like resonator filter patterns 12 or between the disk-like resonator filter patterns 12 and the signal input-output line 13.

It should be noted that although is illustrated that the superconducting resonator filter pattern 12 includes disk patterns in the example shown in FIG. 2A, the position adjusting mechanisms can also be provided even when the superconducting resonator filter pattern 12 is of a hair-pin type.

As shown in FIG. 2B, the dielectric substrate 11 on which the superconducting resonator filter pattern 12 is formed, the dielectric plate 20, and the tuning rod 25 are held in a package 30. The plate adjusting trimmers 23 and the rod adjusting trimmers 26 are arranged on the package 30, and can be fine-adjusted outside the package 30. For example, a window for viewing the inside of the package 30 can be formed on the side wall of the package 30.

Next, the tunable range of the resonator filter is explained.

Figure 3:
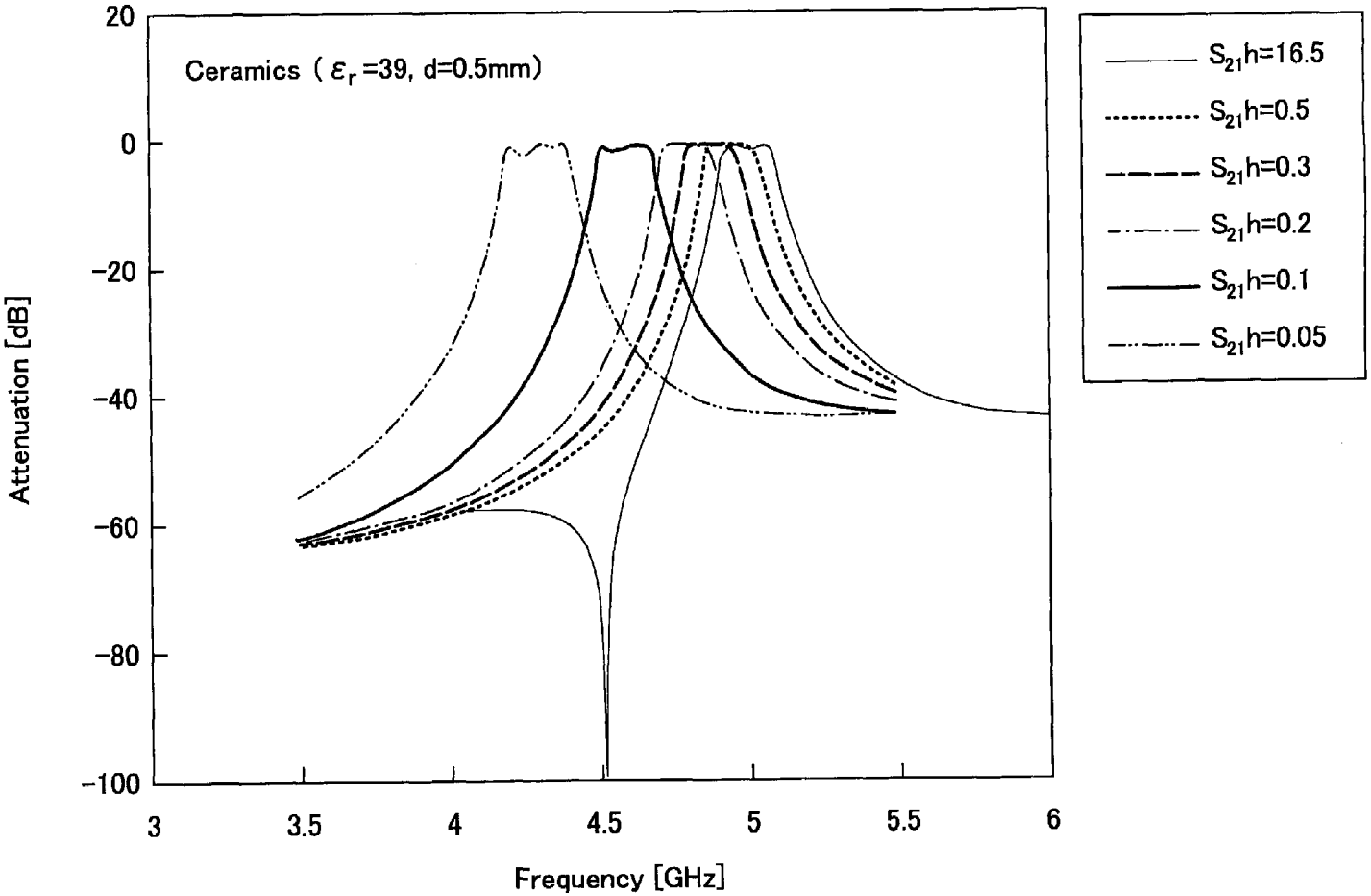
FIG. 3 shows graphs illustrating transmission characteristics of the superconducting tunable filter according to the present embodiment, which includes three stages of superconducting hair-pin resonators.

FIG. 3 shows graphs illustrating transmission characteristics of the superconducting tunable filter according to the present embodiment, which includes three stages of superconducting hair-pin resonators.

Specifically, in the example shown in FIG. 3, the position of each bandwidth tuning rod 25 is fixed. Under these conditions, when the distance h between the disk-like resonator filter patterns 12 and the dielectric plate 20 is changed, the resonating frequency of the superconducting tunable filter changes. The graphs in FIG. 3 illustrate the transmission characteristics (S21) of the superconducting tunable filter when the distance h is changed.

Figure 4:
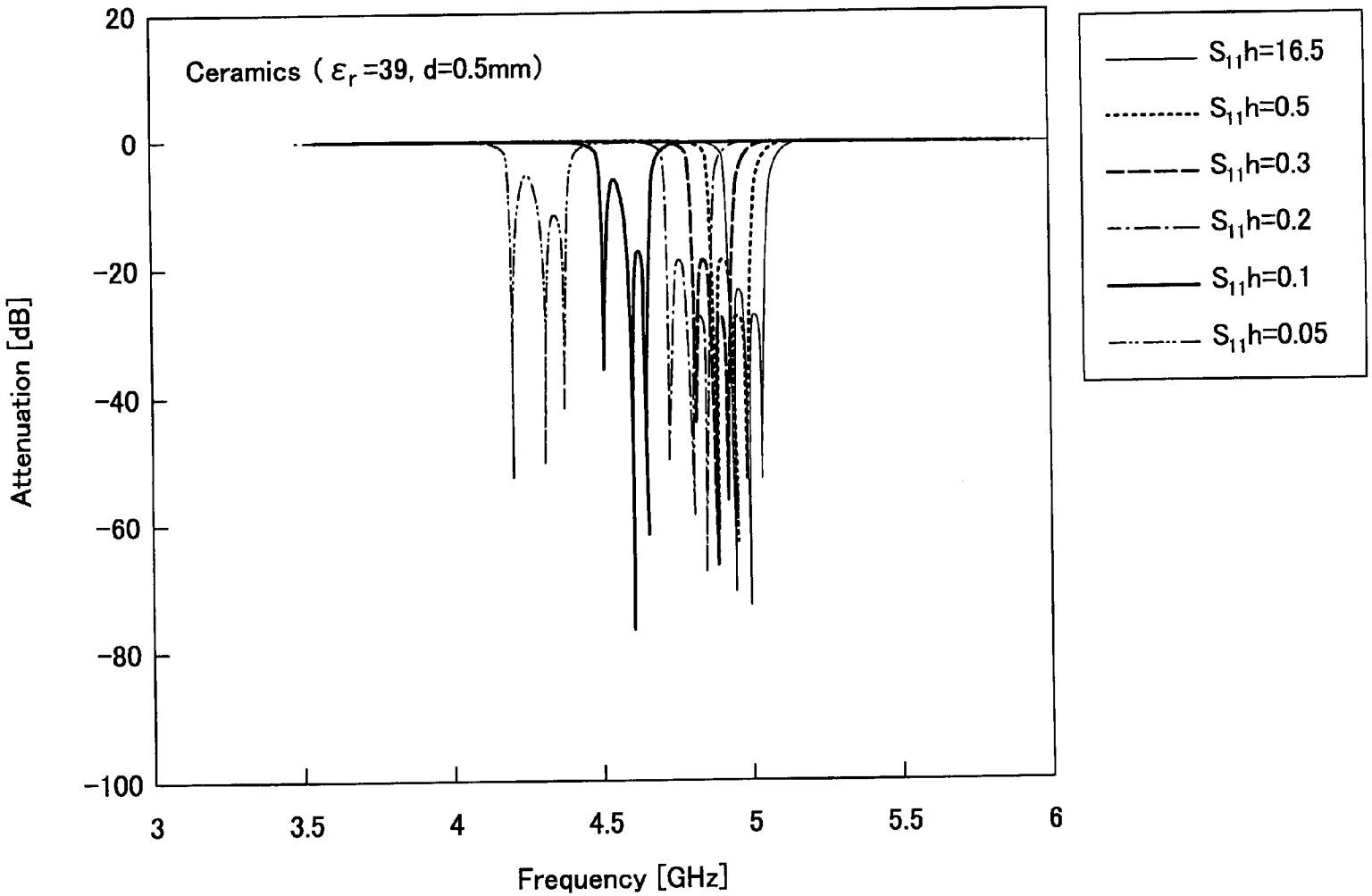
FIG. 4 shows graphs illustrating reflection characteristics (S11) of the superconducting tunable filter as shown in FIG. 3, which has three stages of superconducting hair-pin resonators, when the distance h between the disk-like resonator filter patterns 12 and the dielectric plate 20 is changed.

FIG. 4 shows graphs illustrating reflection characteristics (S11) of the superconducting tunable filter as shown in FIG. 3, which has three stages of superconducting hair-pin resonators, when the distance h between the disk-like resonator filter patterns 12 and the dielectric plate 20 is changed.

In the example shown in FIG. 3 and FIG. 4, the permittivity $\in r$ of the dielectric plate 20 is 39, and the thickness d of the dielectric plate 20 is 0.5 mm.

As shown in FIG. 3 and FIG. 4, with the bandwidth tuning rods 25 being fixed, when the dielectric plate 20 is moved close to the resonator filter patterns 12, the resonating frequency of the superconducting tunable filter shifts to the low frequency side, and the bandwidth increases at the same time. This is because which the effective relative permittivity $\in_{eff}$ of each resonator is increased, the coupling coefficient k between the resonators is increased, and the external Q-value is reduced.

Figure 5:
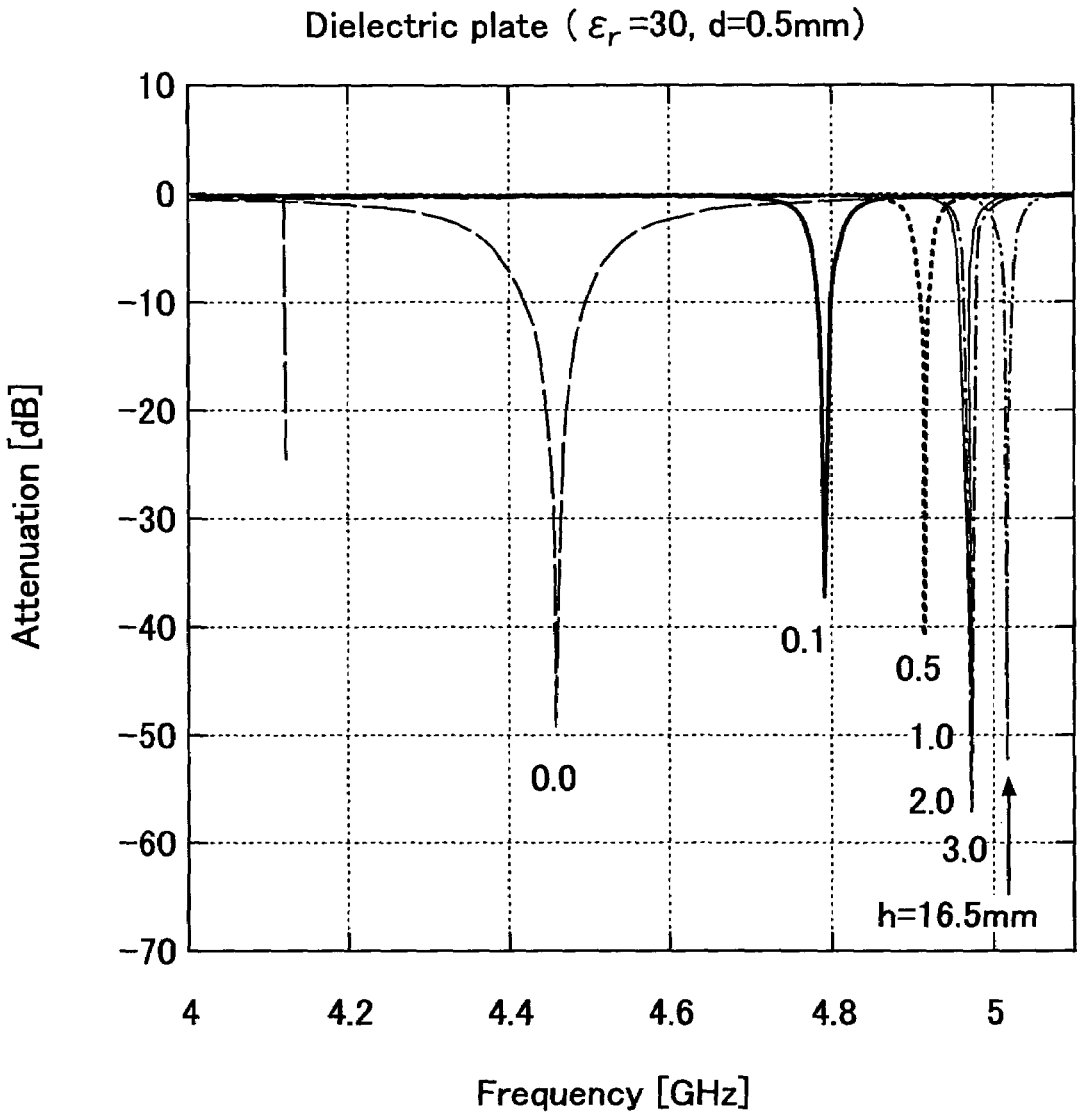
FIG. 5 shows graphs illustrating the reflection characteristics of the superconducting tunable filter according to the present embodiment, which is composed of superconducting disk-type resonators, when the distance h between the disk-like resonator filter patterns 12 and the dielectric plate 20 is changed.

FIG. 5 shows graphs illustrating the reflection characteristics of the superconducting tunable filter according to the present embodiment, which is composed of superconducting disk-type resonators, when the distance h between the disk-like resonator filter patterns 12 and the dielectric plate 20 is changed.

Similarly, in the example shown in FIG. 5, the position of each bandwidth tuning rod 25 is fixed, and the graphs in FIG. 5 show variation of the resonating frequency of the superconducting tunable filter when the distance h is changed. In the example shown in FIG. 5, the permittivity $\in r$ of the dielectric plate 20 is 30, and the thickness d of the dielectric plate 20 is 0.5 mm.

As shown in FIG. 5, when the dielectric plate 20 is moved close to the resonator filter patterns 12, the resonating frequency of the superconducting tunable filter shifts to the low frequency side, and the bandwidth increases at the same time.

Figure 6:
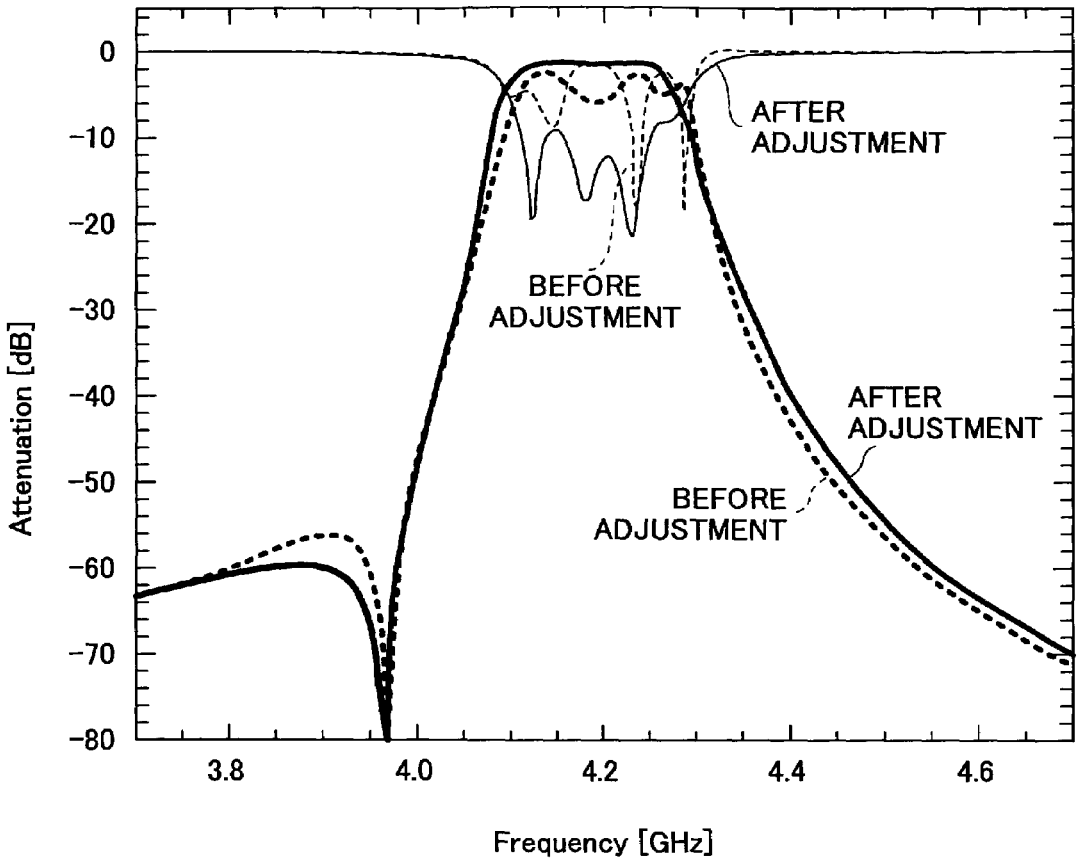
FIG. 6 shows graphs illustrating variation of in-band characteristics of the superconducting tunable filter of the present embodiment after the center frequency is adjusted by using the dielectric plates 20 and the vertical positions of the bandwidth tuning rods 25 are adjusted by using the rod adjusting trimmers 26.

FIG. 6 shows graphs illustrating variation of in-band characteristics of the superconducting tunable filter of the present embodiment after the center frequency is adjusted by using the dielectric plates 20 and the vertical positions of the bandwidth tuning rods 25 are adjusted by using the rod adjusting trimmers 26.

In this example, the superconducting tunable filter is composed of three stages of the superconducting hair-pin resonators, and the bandwidth tuning rods 25 are arranged above the hair-pin resonators and at positions corresponding to the spaces between adjacent hair-pin resonators.

In FIG. 6, dotted lines represent the in-band characteristics of the superconducting tunable filter prior to adjustment, and solid lines represent the in-band characteristics after adjustment. As shown in FIG. 6, by making fine adjustments with the bandwidth tuning rods 25, ripples are reduced, and the in-band characteristics of the superconducting tunable filter are optimized. In other words, independent from control of the dielectric plate 20, it is possible to set the resonator coupling coefficient k or the external Q-value variable.

As described above, according to the present embodiment, not only the center frequency of the superconducting tunable filter, but also the bandwidth of the superconducting tunable filter can be adjusted independently as desired. Due to this, a superconducting tunable filter of good quality is obtainable. When the superconducting tunable filter is applied to a RF front-end of a base station in a mobile communication system, it is possible to improve frequency utilization.

While the invention is described above with reference to specific embodiments chosen for purpose of illustration, it should be apparent that the invention is not limited to these embodiments, but numerous modifications could be made thereto by those skilled in the art without departing from the basic concept and scope of the invention.

For example, it is described that YBCO (Y—Ba—Cu—O) based materials are used as the superconducting material of the resonator filter pattern 12, but the present invention is not limited to this, and any oxide superconducting material can be used. For example, thin films of RBCO (R—Ba—Cu—O) based materials can be used. That is, as the R element, instead of Y (Yttrium), Nd, Sm, Gd, Dy, Ho can be used in the superconducting material. In addition, BSCCO (Bi—Sr—Ca—Cu—O) based materials, PBSCCO (Pb—Bi—Sr—Ca—Cu—O) based materials, CBCCO ($Cu—Ba_p—Ca_q—Cu_r—O_x$) based materials (where, $1.5 \leqq p \leqq 2.5$, $2.5 \leqq q \leqq 3.5$, $3.5 \leqq r \leqq 4.5$) can be used as the superconducting materials.

The dielectric substrate 11 is not limited to the MgO single crystal substrate. For example, the dielectric substrate 11 may be a $LaAlO_3$ substrate, or a sapphire substrate.

The dielectric plate 20 and the bandwidth tuning rod 25 are not limited to sapphire. For example, MgO, $LaAlO_3$, $NdGaO_3$, LSAT, $LaSrGaO_4$, $LaGaO_3$, YSZ, or $TiO_2$ may also be used. Further, the plate 20 and the bandwidth tuning rod 25 may also be formed from magnetic materials. In this case, for example, magnet YIG can be used for the plate 20 and the bandwidth tuning rod 25.

The mechanisms for changing positions of the dielectric plate 20 and the bandwidth tuning rod 25 are not limited to the plate adjusting trimmer 23 and the rod adjusting trimmer 26. For example, piezoelectric actuators or MEMS elements may be used. In this case, the piezoelectric actuators or MEMS elements for controlling the dielectric plate 20, and the piezoelectric actuators or MEMS elements for controlling the bandwidth tuning rod 25 are arranged separately, and are controlled separately.

What is claimed is:

1. A superconducting tunable filter, comprising:

a resonator filter pattern that is formed from a superconducting material and is formed on a dielectric substrate;

a dielectric or magnetic plate that is arranged above the resonator filter pattern and has a through-hole;

a dielectric or magnetic rod that is inserted in the through-hole; and a position controller that separately controls a position of the dielectric or magnetic plate and a position of the dielectric or magnetic rod relative to the resonator filter pattern, wherein the resonator filter pattern is an arrangement pattern including plural disk-like resonators arranged adjacent to each other, and the through-hole is located between adjacent two of the adjacent disk-like resonators or between the disk-like resonators and an input-output feeder for transmitting signals to the disk-like resonators.

2. The superconducting tunable filter as claimed in claim 1, wherein the position controller includes a rod adjusting trimmer for adjusting the position of the dielectric or magnetic rod relative to the resonator filter pattern.

3. The superconducting tunable filter as claimed in claim 1, wherein the position controller includes a plate adjusting trimmer for adjusting the position of the dielectric or magnetic plate relative to the resonator filter pattern.

4. The superconducting tunable filter as claimed in claim 1, wherein the position controller includes plural piezoelectric actuators or MEMS elements arranged respectively on the dielectric or magnetic plate and the dielectric or magnetic rod.

5. The superconducting tunable filter as claimed in claim 1, wherein the resonator filter pattern is a two-dimension circuit pattern.

6. The superconducting tunable filter as claimed in claim 1, further comprising:

a package that accommodates the dielectric substrate with the superconducting resonator filter pattern formed thereon, the dielectric or magnetic plate, and the dielectric or magnetic rod;

wherein the position controller is arranged outside the package.

7. The superconducting tunable filter as claimed in claim 6, wherein the position controller includes plural adjusting trimmers arranged on the package corresponding to the dielectric or magnetic plate and the dielectric or magnetic rod, respectively.

* * * * *